US005875596A

United States Patent [19]

Muller

[11] Patent Number: 5,875,596

[45] Date of Patent: Mar. 2, 1999

[54] LIGHTWEIGHT PANEL STRUCTURE

[75] Inventor: Vlad Muller, Etobicoke, Canada

[73] Assignee: Global Upholstery Company, Downsview, Canada

[21] Appl. No.: 865,701

[22] Filed: May 30, 1997

[30] Foreign Application Priority Data

Feb. 28, 1997 [CA] Canada ..... 2198829

[51] Int. Cl.[6] ..... E04H 1/00

[52] U.S. Cl. ..... 52/239; 52/238.1; 52/806; 52/793.1; 160/135

[58] Field of Search ..... 52/239, 241, 238.1, 52/784.14, 793.1, 793.11, 806, 36; 160/135, 351

[56] References Cited

U.S. PATENT DOCUMENTS

| | | | |
|---|---|---|---|
| 3,359,022 | 12/1967 | Russell | 287/189.36 |
| 3,803,787 | 4/1974 | Daggy | 52/241 |
| 3,990,204 | 11/1976 | Haworth et al. | 52/239 |
| 4,021,973 | 5/1977 | Hegg et al. | 52/36 |
| 4,067,165 | 1/1978 | Timmons | 52/585 |
| 4,084,367 | 4/1978 | Saylor et al. | 52/615 |
| 4,310,995 | 1/1982 | Hanna | 52/806 |
| 4,437,278 | 3/1984 | Thomas, Jr. | 52/239 |
| 4,534,146 | 8/1985 | Preston | 52/239 |
| 4,571,907 | 2/1986 | DeFouw et al. | 52/239 |
| 4,667,450 | 5/1987 | Stefnik et al. | 52/238.1 |
| 4,716,692 | 1/1988 | Harper et al. | 52/36 |
| 4,891,922 | 1/1990 | Hozer et al. | 52/239 |
| 4,898,284 | 2/1990 | Arens | 211/162 |
| 4,918,886 | 4/1990 | Benoit et al. | 52/221 |
| 4,949,518 | 8/1990 | Nagel et al. | 52/239 |
| 4,956,953 | 9/1990 | Bates | 52/239 |
| 4,976,080 | 12/1990 | Zegel et al. | 52/239 |
| 5,065,559 | 11/1991 | Zegel et al. | 52/239 |
| 5,067,294 | 11/1991 | McGowan | 52/241 |
| 5,125,201 | 6/1992 | Pieters et al. | 52/238.1 |
| 5,188,246 | 2/1993 | Maxworthy | 211/153 |
| 5,252,111 | 10/1993 | Spencer et al. | 55/489 |
| 5,332,108 | 7/1994 | Blass | 211/90 |
| 5,339,576 | 8/1994 | Fussler | 52/239 X |
| 5,346,078 | 9/1994 | Ernetoft | 211/90 |
| 5,377,466 | 1/1995 | Insalaco et al. | 52/239 X |
| 5,485,933 | 1/1996 | Crooymans | 211/90 |
| 5,491,943 | 2/1996 | Vondrejs et al. | 52/239 |
| 5,546,718 | 8/1996 | Way | 52/238.1 |
| 5,689,924 | 11/1997 | Mason | 52/239 |

*Primary Examiner*—Creighton Smith
*Attorney, Agent, or Firm*—Philip Mendes da Costa Bereskin & Parr

[57] ABSTRACT

A panel structure comprises a frame members defining the perimeter of the panel structure. The frame members have a first side facing outwardly of the panel structure and an opposed side facing inwardly. A panel member extends between the frame members and is engagable therewith. The panel member comprises an inner honeycomb core constructed from cellulosic material and having a pair of opposed side faces and a pair of opposed side panel members having a first side facing outwardly of the panel structure and an opposed side facing inwardly. Each of the opposed side faces is affixed to a respective side of the honeycomb core. The side panels are constructed essentially from material which, when not affixed to the honeycomb core, is non-structural and, when affixed to the honeycomb core, has a tensile strength sufficient to prevent compressive movement of the opposed side of the honey comb core.

9 Claims, 8 Drawing Sheets

LIGHTWEIGHT PANEL STRUCTURE

FIELD OF THE INVENTION

This invention relates to panel structures or assemblies such as those which are used as space dividers and screens for sub-dividing offices and other space.

BACKGROUND OF THE INVENTION

Panel assemblies for use in sub-dividing office and other space have typically been constructed from elongate frame members. The frame members may be made from extruded aluminium or rolled sheet metal. The central panel structure which extends between the frame members is an opaque barrier member thereby providing some privacy. A plurality of panel assemblies may be secured together to define a space which has some degree of privacy, depending upon the size of the panels and the number of panels which are assembled together. (See for example U.S. Pat. No. 5,491,943 to Vondrejs et al).

The central panel member may be designed for various requirements. For example, it may be sub-divided it one or more units and may include channels for wiring (e.g. AC wiring and/or communication wiring).

Saylor et al discloses a sound absorbing panel. The panel has a ridged rectangular frame and a core structure which is disposed within the region bounded by the frame. The core comprises at least one honeycomb layer with thin facing sheets disposed on and fixedly secured to the opposed sides of the rectangular frame. A plurality of openings are formed in either or both of the skins so that approximately a single opening will communicate with a single cell of the honeycomb layer. The facing sheets are disclosed as being made from thin sheet metal (see the abstract and column 4, lines 59–68).

U.S. Pat. No. 4,310,995 discloses a panel assembly which also includes a honeycomb core. The panel assembly includes an exterior frame member. Foam material defines an interior perimeter extending between the honeycomb layer an the exterior frame member. As shown in the drawings of this patent, the side panels are constructed from a plurality of layers of planer and corrugated material.

U.S. Pat. No. 4,437,278 discloses a wall partition having an interior honeycomb member and opposed spaced panels which may be made from plastic laminate, hardboard or wood veneer (column 2, lines 5–11).

U.S. Pat. No. 4,667,450 discloses a wall panel having an interior honeycomb construction. The opposed side faces of the panel are preferably constructed from gypsum board sheets (column 7, lines 34–35).

The honeycomb core of these various patents provides a lightweight member to the panel assembly. However, one disadvantage of some of these constructions is that the opposed side walls are constructed from relatively heavy materials. For example, U.S. Pat. No. 4,084,367 (Saylor et al) utilizes sheet metal as the side panels while U.S. Pat. No. 4,667,450 utilizes drywall. Accordingly, the benefits from using a lightweight honeycomb filler is lost by the use of such heavy construction materials. Accordingly, overall, the panel is not of a lightweight construction.

A further disadvantage of some of the constructions is that the material which is used for the opposed side walls is relatively expensive. As stated above, U.S. Pat. No. 4,084,367 utilizes sheet metal while U.S. Pat. No. 4,667,450 utilizes drywall. In addition, U.S. Pat. No. 4,437,278 utilizes plastic laminate, hardboard or wood veneer, each of which is a relatively expensive building product. Further, U.S. Pat. No. 4,310,995 uses a multi-wall laminated construction. The manufacturer of such a construction requires multiple manufacturing steps and accordingly this adds to the overall cost of the unit.

SUMMARY OF THE PRESENT INVENTION

In accordance to the instant invention there is provided a panel structure comprising a frame members defining the perimeter of the panel structure, the frame members having a first side facing outwardly of the panel structure and an opposed side facing inwardly, and a panel member extending between the frame members and engage therewith. The panel member comprises an inner honeycomb core constructed from cellulosic material and having a pair of opposed side faces and, a pair of opposed side panel members having a first side facing outwardly of the panel structure and an opposed side facing inwardly. Each of the opposed side faces is affixed to a respective side of the honeycomb core. The side panels are constructed essentially from material which, when not affixed to the honeycomb core, is non-structural and, when affixed to the honeycomb core, has a tensile strength sufficient to prevent compressive movement of the opposed side of the honeycomb core.

In accordance with another embodiment of this invention there is provided a panel structure comprising frame members defining the perimeter of the panel structure, the frame members having a first side facing outwardly of the panel structure and an opposed side facing inwardly, and a panel member extending between the frame members and engagable therewith. The panel member comprises an inner core having an open cell structure having a pair of opposed side faces, and a pair of opposed side panel members having a first side facing outwardly of the panel structure and an opposed side facing inwardly. Each of the opposed side faces is affixed to a respective side of the inner core. The side panels are constructed essentially from material which, when only one of the side panel members is affixed to the inner core, the only one of the side panel members will not prevent bending of that side of the inner core when a bending force is applied to opposed sides of the inner core and yet has a tensile strength sufficient to prevent compressive movement of the opposed side of the inner core when both of the panel members are affixed to the inner core.

In accordance with a further embodiment of the this invention there is provided a panel structure comprising top, bottom and side frame members defining the perimeter of the panel structure, the frame members having a first side facing outwardly of the panel structure and an opposed side facing inwardly, and a panel member extending between the frame members. The opposed sides of the frame members are configured to receive therein the panel member. The panel member comprises an inner honeycomb core of corrugated paper and a pair of opposed side panel members having a first side facing outwardly of the panel structure and an opposed side facing inwardly. Each of the opposed side faces is affixed to a respective side of the inner core. The side panels are constructed from a cardboard having a thickness less than about 0.05 inches.

Preferably, the honeycomb core has cell openings which are less than about 1.5 inches, more preferably less than about 1.0 inches and most preferably, less than about 0.5 inches. Further, the honeycomb core is preferably constructed from paper having a thickness of less than about 0.025 inches, more preferably less than about 0.015 inches and, most preferably less than about 0.01 inch.

Preferably, the opposed side panels are constructed from cellulosic material, such as planer (non-corrugated) cardboard or paper. However, other lightweight construction materials which can absorb tensile forces, such as thin foils or films (e.g. aluminum foil), might be utilized. If the side panel members are constructed from a cellulosic material, the exterior surface may be treated so as to be water resistant or water proof. For example, the exterior surface may be treated with a water resistant or waterproof compound or it may be covered with a water proof or water resistant material. In one embodiment, the exterior surface of the side panel members may be aluminized. Preferably, the opposed side panel members are constructed from planer cardboard and preferably having a thickness of less than about 0.05 inches, more preferably less than about 0.025 inches and, most preferably less than about 0.02 inches.

The panel structure of the instant invention is of a lightweight construction. In a preferred embodiment, the panel member may be constructed of paper and/or planer cardboard. Quite surprisingly, despite this construction, the panel member has sufficient structural integrity to be used as a office panel system without the need for internal reinforcement members provided on the interior of the panel member. For example, it has been determined that a panel structure constructed in accordance with the instant invention may accommodate a shelf which is capable of supporting up to 150 lbs. This is quite notable given the lightweight construction of the instant panel structure.

DESCRIPTION OF THE DRAWING FIGURES

These and other advantages of the instant invention will be more fully understood by the following description of a preferred embodiment, by way of example, in conjunction with the accompanying drawings.

DESCRIPTION OF PREFERRED EMBODIMENT

Figure 1:
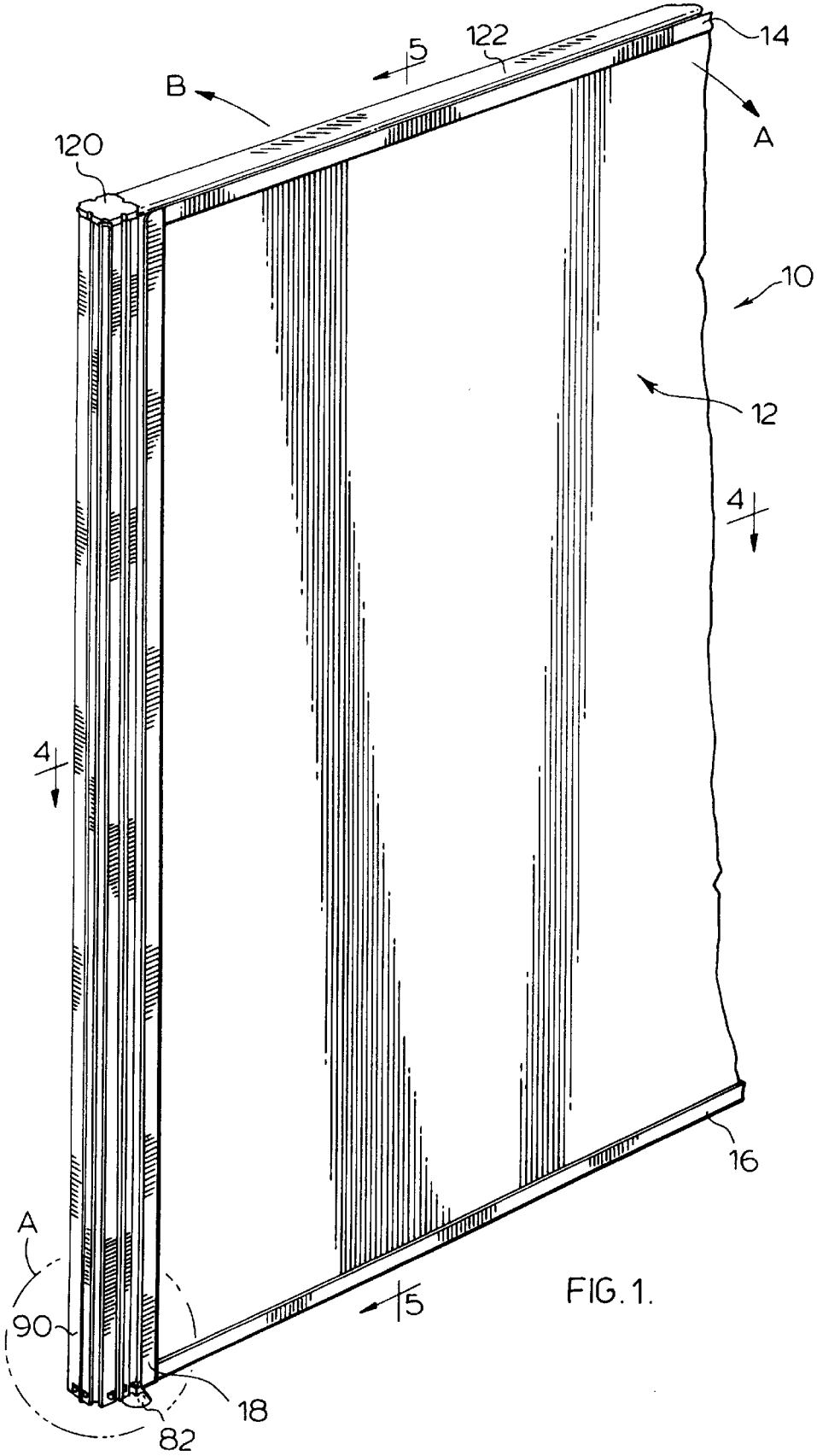
FIG. 1 is a perspective view of a panel assembly according to the instant invention.

Referring to FIG. 1, there is shown a panel structure 10 comprising a panel member 12 and surrounded by frame members comprising a top frame member 14, a bottom frame member 16 and a pair of vertical frame members 18 (only one of which is shown in FIG. 1).

Frame members 14, 16 and 18 may be constructed from any material shown in the art and may be of any particular configuration which is adapted to engage panel member 12. Preferably, frame members 14, 16 and 18 are made from thin gauge metal (e.g. the frame members may have side walls which have a thickness of about 0.125 inches or less, preferably from about 0.030 to about 0.070 inches and more preferably from about 0.040 to about 0.060 inches). Preferably they are made from aluminium. Depending upon the configuration of the sheet metals, it may be preferably to manufacture them by extrusion.

Together, frame members 14, 16 and 18 define the exterior perimeter of panel structure 10 and define a perimeter extending around panel member 12. Frame members may inter-engage by any means known in the art. For example, top frame member 14 may inter-engage opposed vertical frame members 18 so as to define a continuous top and side perimeter around panel member 12. Similarly, bottom frame member 16 may inter-engage opposed vertical frame members 18 so as to define the remainder of the perimeter around panel member 12. Alternately, a connector means, such as bracket 20, may be used to connect the frame members together.

Figure 3:
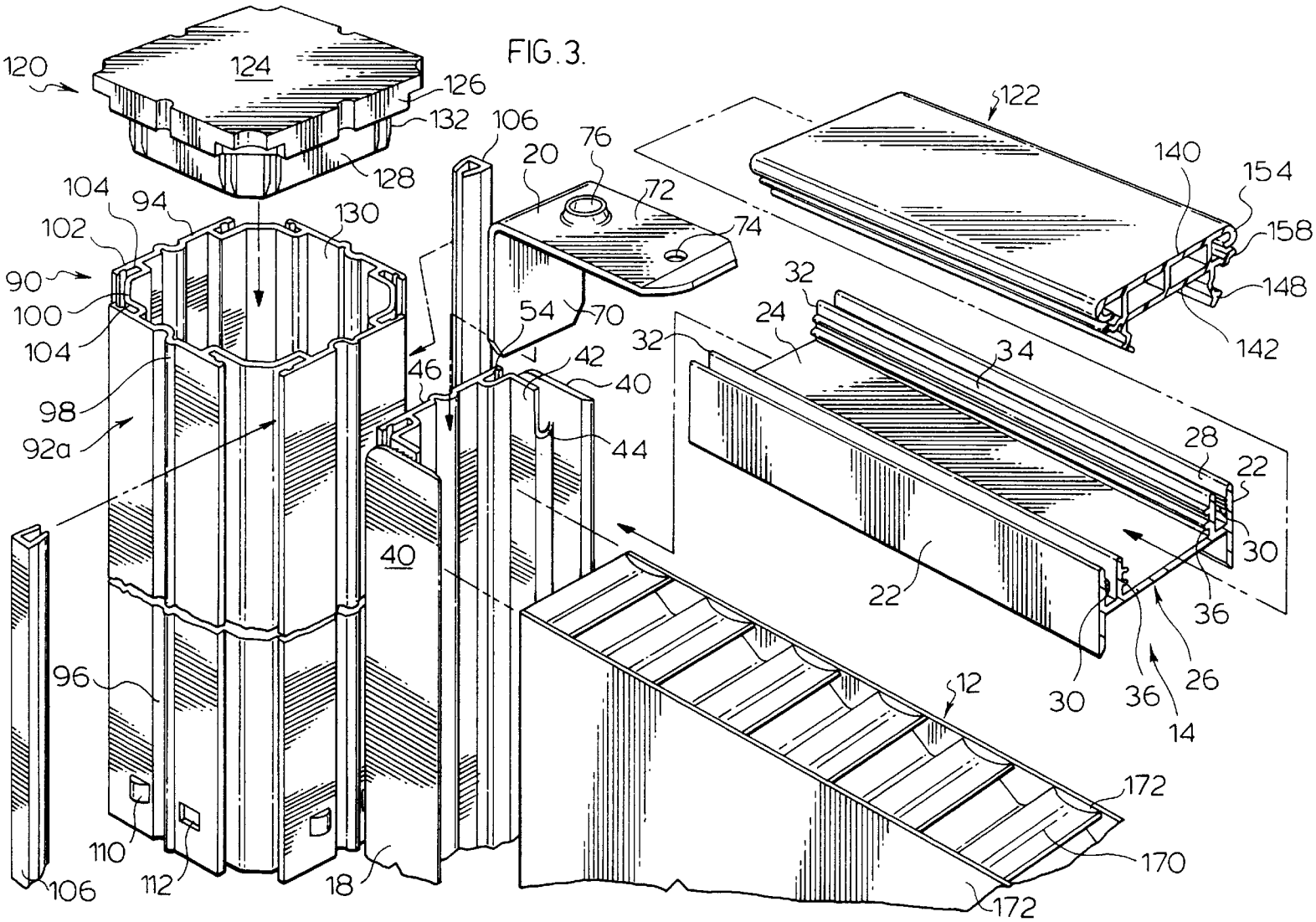
FIG. 3 is a partially exploded view of the panel shown in FIG. 1.

As shown in FIG. 3, top frame member 14 may be a longitudinally extending member having a generally I-beam shaped configuration in cross section. Accordingly, top frame member 14 may have a pair of opposed vertical faces 22 with a generally horizontal web member 24 extending therebetween. Web member 24 may extend from a position approximately mid-way along the interior surface of vertical faces 22. The lower portion of vertical faces 22 and the bottom surface of web member 24 define a generally U-shaped channel 26.

Figure 5:
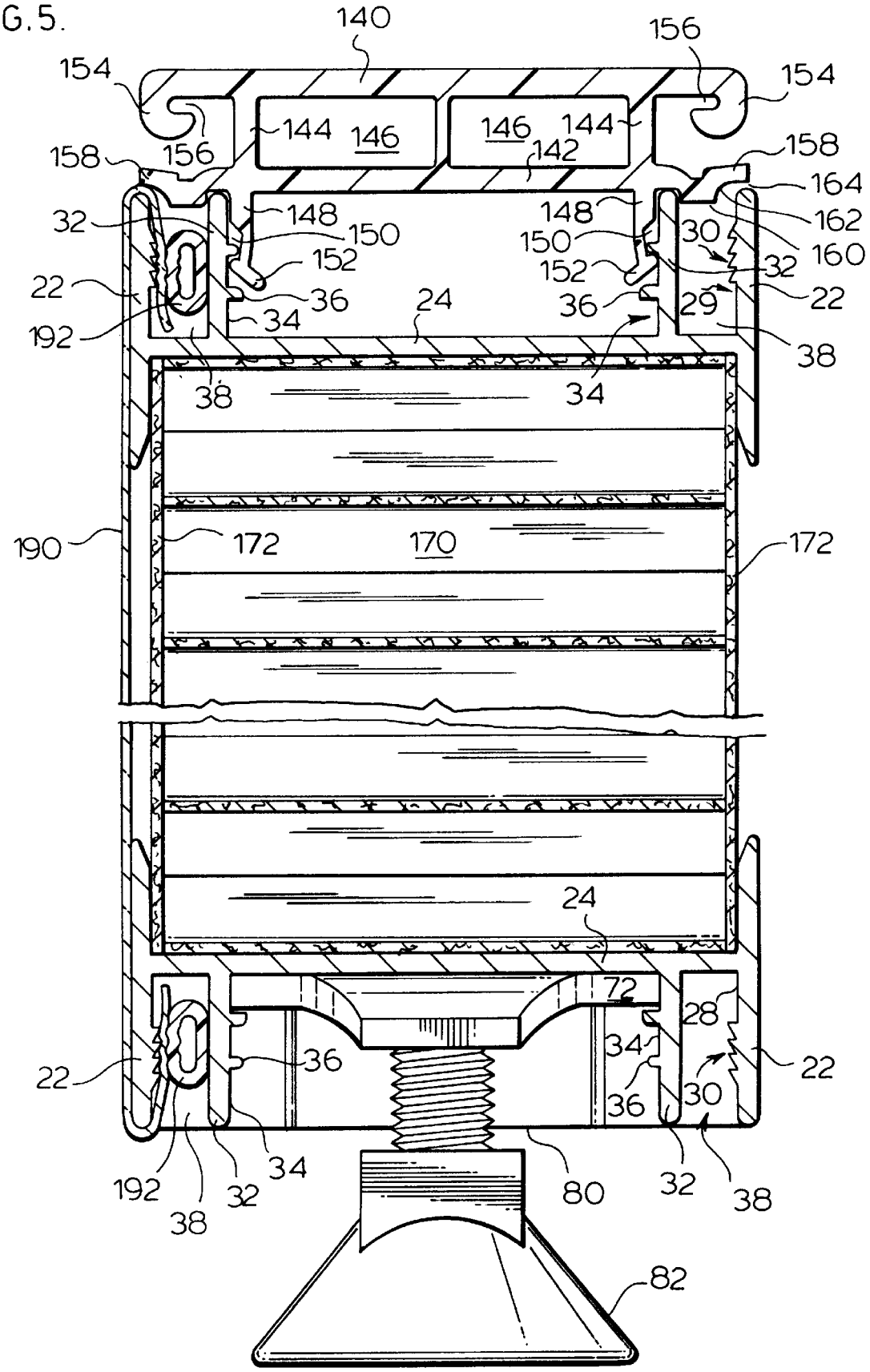
FIG. 5 is a cross-section along the line of 5—5 of the panel of FIG. 1.

Preferably, top frame member 14 is configured to receive therein the edges of a fabric material which overlays panel member 12. Further, top frame member 14 may be configured to receive a top cap to provide a clean, decorative finish to panel structure 10. Accordingly, as shown in FIG. 5, vertical faces 22 may extend upwardly from web member 24 and define an internal surface 28. A plurality of horizontally extending protrusions (e.g. raised surfaces) may be provided on interior surface 28. Positioned inwardly from each of interior surfaces 28 is a generally vertically extending top cap securing arm 32. Top cap securing arms 32 have an interior surface 34 having a plurality of horizontally extending flange members 36 provided thereon. Horizontally extending channels 38 extends between vertical faces 22 and top cap securing arms 32.

Bottom frame member 16 may be of a similar construction to top frame member 14 and, preferably, is of an identical construction. If top and bottom frame members 14 and 16 are of an identical construction, then only one frame member need be manufactured and stocked as opposed to two.

Figure 4:
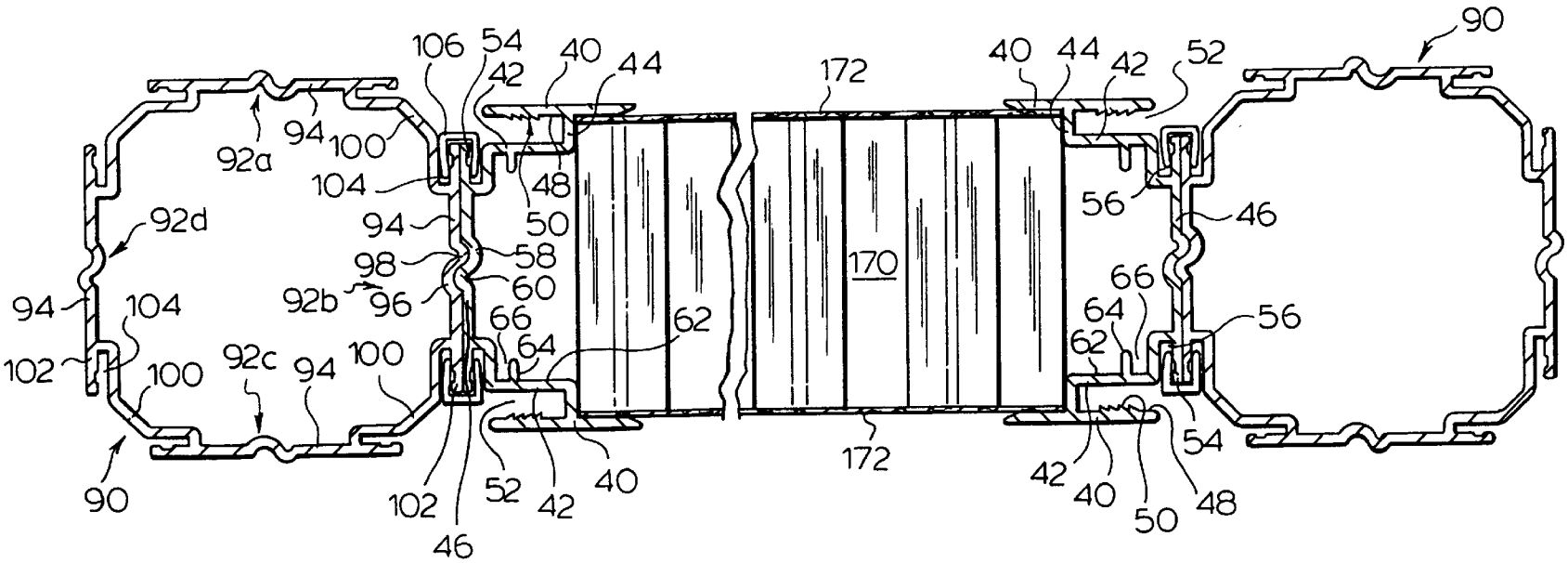
FIG. 4 is a cross-section along the line 4—4 of the panel of FIG. 1.

Vertical frame members 18 may also be of any particular configuration provided they are adapted to engage panel member 12. As shown in FIGS. 3 and 4, vertical frame members 18 may be longitudinally (vertically) extending extrusions having vertically extending outer side faces 40 and vertically extending inner side faces 42. Inner and outer side faces 40 and 42 are connected together by first vertically extending web member 44 which is positioned approximately mid-way along the interior surface of outer side face 40. Each inner side face 42 extends between an inner end of first web member 44 and an outer end of second vertically extending web member 46.

Outer side faces 40 have an interior surface 48 having a plurality of protrusions 50 (e.g. raised surfaces). Each outer side face 40, inner side face 42 and first web member 44 define a vertically extending channel 52. Outer side faces 40 and web member 44 define a generally U-shaped channel for receiving panel member 12.

Second web member 46 may be configured to engage another panel structure 10 or a post by any means known in the art. For example, second web member 46 may be configured as disclosed in U.S. Pat. No. 5,491,943 (Vondrejs et al) which is incorporated herein by reference. Accordingly, second web member 46 may have a pair of connector arms 54 extending outwardly therefrom. Each connector arm 54 and web member 46 define a generally vertically extending channel 56. Further, second web member 46 may have a generally vertically extending recess 58 and a generally vertically extending protrusion 60.

Inner side face 42 has an interior surface 62. A longitudinally extending protrusion 64 is provided on interior surface 62 adjacent second web member 46. Each protrusion 64 and second web member 46 define a shallow channel 66.

Bracket 20 may be of any particular design to secure frame members 14, 16 and 18 together. In order to simplify the construction of frame structure 10, a single bracket 20 is used at each corner of panel structure 10. As shown in FIG. 3, bracket 20 has a first arm 70 and a second arm 72. First arm 70 is sized so as to be received in channel 66 in vertical frame member 18. Second arm members 74 is sized so as to be received on top of horizontal web member 24 between top cap securing arms 32 (see in particular FIG. 5). In order to secure second arm member 72 to top or bottom frame member 14/16, screw hole 74 may be provided in second arm member 72. A screw such as a set screw or a self taping screw may be threaded through screw hole 74 into web member 24 to secure second arm 72 of bracket 20 in position. Longitudinally extending protrusions 64 on inner surface 62 of vertical frame members 18 assist in maintaining bracket 20 in position once it is inserted into channel 66. If desired, screw means or some other means (not shown) may be utilized to fixedly secure second arm 70 in vertical member 18.

Panel structure 10 preferably also includes a leg so that bottom frame member 16 is positioned above the ground. Accordingly, second arm 72 of bracket 20 may be provided with a second hole, namely leg screw hole 76. Referring to FIG. 5, leg screw hole 76 is adapted to receive a screw 80 which extends upwardly from leg 82. As will be appreciated by those skilled in the art, any particular leg may be used in association with panel structure 10 and any particular connecting means may be used to affix the leg to panel structure 10.

Panel structure 10 may be connected to a like panel member by any means known in the art. Alternately, panel structure 10 may be affixed to a vertically extending post 90 which may be of any desired configuration. If post 90 is of a generally square configuration, then up to four panels may be affixed to either side of post 90. Accordingly, vertical frame member 18 may be affixed to a second vertical frame member 18 of a similar or dissimilar construction by any means known in the art or vertical frame member 18 may be affixed to a vertically extending post 90 by any means known in the art.

Figure 6:
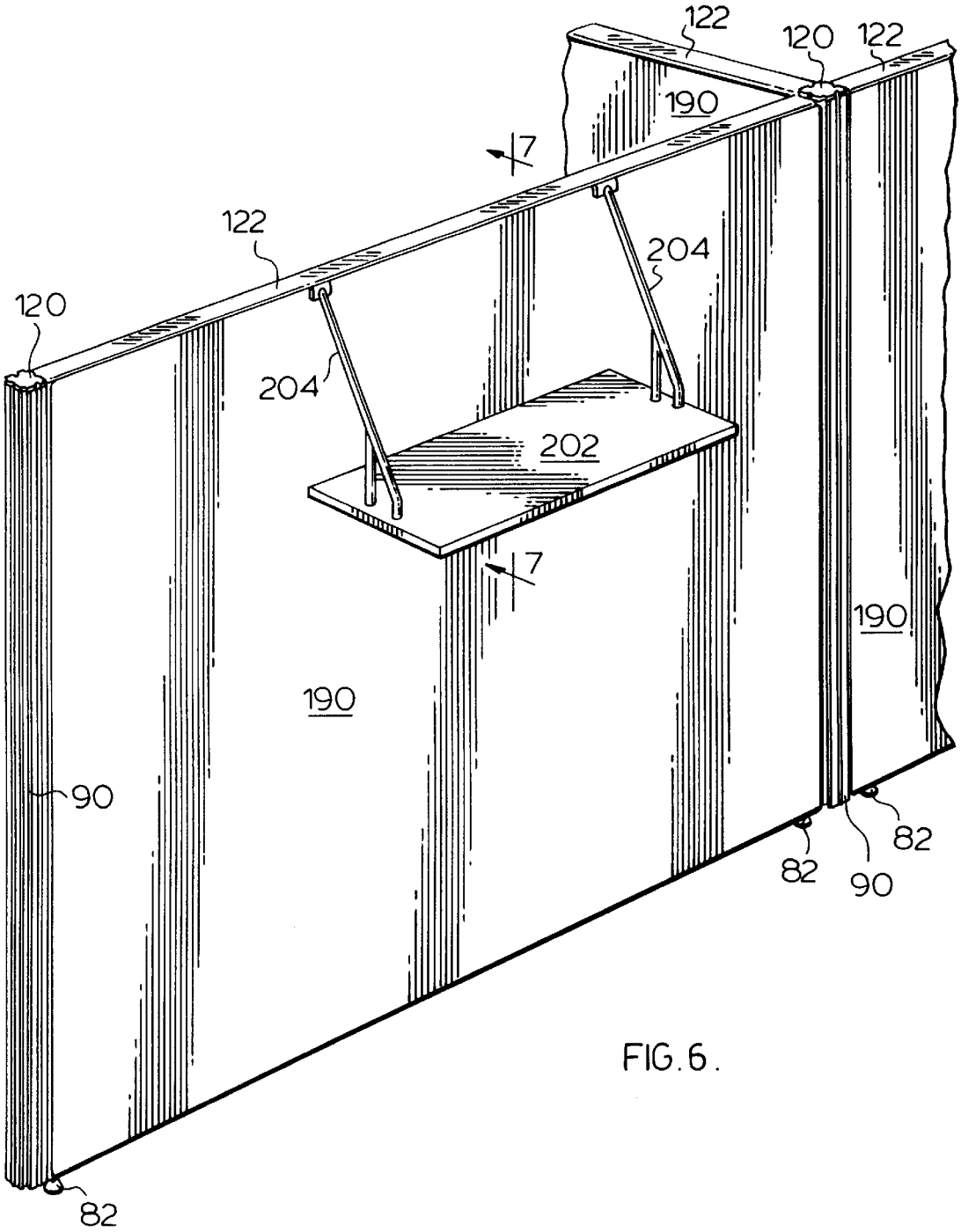
FIG. 6 is a perspective view of a wall panel having a shelf positioned thereon.

As shown in FIG. 4, vertically extending post 90 may have four faces 92*a, b, c* and *d*. Accordingly, as shown in FIG. 6, a post 90 may have a panel structure 10 connected to more than one face 92*a, b, c, d*.

Preferably, the connection method disclosed in Vondrejs et al is utilized. Therefore, each face 92*a, b, c, d* may have a web member 94 having a vertically extending recess 96 and a vertically extending protrusion 98. Recess 96 and protrusion 98 are complimentary to recess 58 and protrusion 60 of vertical frame member 18 so that vertical face 92*a, b, c, d* may inter-engage with second web member 46 of vertical frame member 18.

Web members 94 are connected together by connector web members 100. A pair of opposed connector arms 102 extend outwardly from either side of each web member 94. Accordingly, each connector arm 102 and the associated connector web member 100 define a generally vertically extending channel 104. When a vertical frame member is aligned with a face 92*a, b, c, d* of vertical post 90 as shown in FIG. 4, each connector arm 52 of vertical frame member 18 abuts a connector arm 102 of vertical post 90. A generally C-shaped clip 106 may be positioned around connector arms 54 and 102 to secure vertical frame member 18 to vertical post 90.

Figure 8:
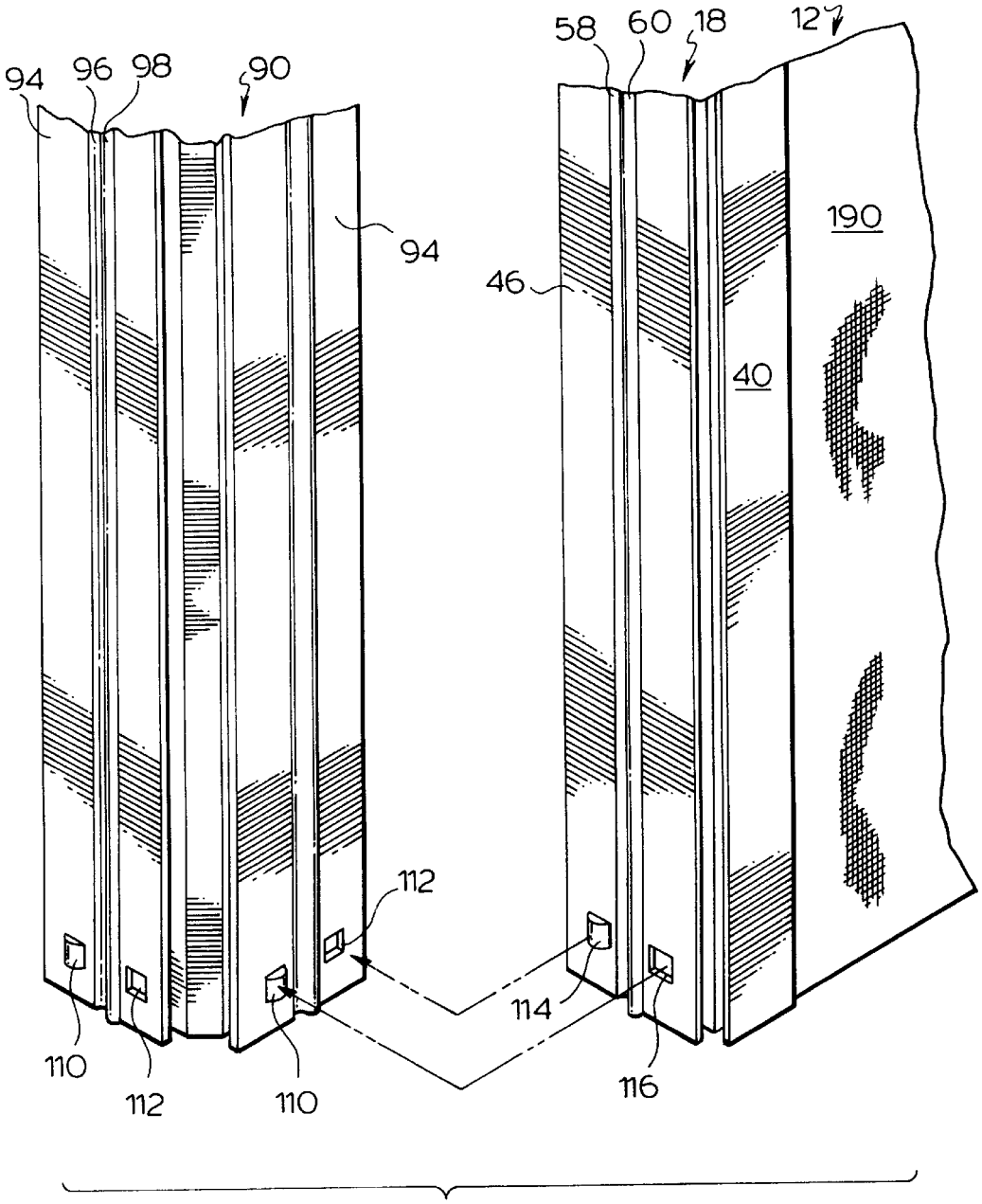
FIG. 8 is an enlargement of a partial exploded view of Area A of FIG. 1.

Complimentary shaped recesses 58 and 96, and complimentary shaped protrusions 60 and 98 prevent relative lateral motion of vatical frame member 18 and post 90 when they inter-engage. In order to further assist in the assembly of panel structure 10, vertical alignment means may be provided. Accordingly, as shown in FIG. 3, each face 92*a, b, c, d* is provided with a projecting member 110 and a recess 112. Similarly, as shown in FIG. 8 second web member 46 of vertical frame member 18 is provided with a projecting member 114 and a recess 116. Recess 112 is shaped to receive projecting member 114. Similarly, recess 116 is shaped to receive projecting member 110. Preferably, a pair of projecting member and recess is provide on opposed sides of the respective vertically extending recesses 58, 96 and protrusions 60, 98. Accordingly, as shown in FIG. 3, projection member 110 and recess 112 are provided on opposed sides of recess 96 and protrusion 98. The projecting members 110, 114 and recesses 112, 116 are provided at a pre-set distance along the vertical extent of each vertical face 92*a, b, c, d,* and second web member 46. Accordingly, when the projecting members 110 and 114 engage their respective recess 112 and 116, vertical frame member 18 is at a preset height with respect to vertical post 90. Further, the projecting members and their respective recesses assist in maintaining the appropriate vertical alignment of vertical frame member on vertical post 90 while C-shaped clip 106 is installed.

In order to provide a completed top cover to vertical post 90 and top frame member 14, post top cap 120 and horizontal top cap 122 may be provided. Top caps 120 and 122 may be of any particular design which may be affixed to the top of vertical post 90 and top frame member 14. Further, top caps 120 and 122 may be made from any material known in the art and are preferably made from plastic.

Post top cap 120 has a top surface 124, first vertically descending side walls 126 and second vertically descending side walls 128. First vertical side walls 126 provide a decorative exterior surface and are preferably contoured to conform to the cross-sectional profile of vertical post 90. Second vertical side walls 128 are recessed inwardly from first vertical side walls 126 so as to define an abutment surface (not shown) which sits on the top of vertical post 90 when post top cap 120 is inserted therein. Preferably, second vertical side walls 128 frictionally engage interior walls 130 of vertical post 90 so that post top cap 120 may be releasably attached to vertical post 90. Accordingly, a plurality of abutment members 132 may be provided around the perimeter of second vertical side walls 128.

Referring to FIG. 5, a particular embodiment of horizontal top cap 122 is shown. In this embodiment, horizontal top cap 122 has upper and lower web members 140 and 142 which are spaced apart by means of vertical web members 144 so as to define two horizontally extending enclosed channels 146. Lower web member 142 has two vertically descending legs 148. Each leg 148 has a longitudinally extending channel 150 provided on the exterior surface thereof and the flange member 152 provided at the bottom thereof. Legs 148 are spaced apart a distance slightly less than the distance between top cap securing arms 32 so that when legs 148 are inserted into horizontal frame member 14, the exterior surface of legs 148 is positioned adjacent interior surface 34 of top cap securing arms 32. Further, channel 150 is positioned so as to receive at least one flange member 36 of top cap securing arms 32. Flange member 152 is positioned so as to abut against the bottom of the flange member 36 which is received in channel 150. Further, flange member 152 is preferably angled inwardly. Accordingly, horizontal top cap 122 may be assembled by aligning legs 148 so as to be positioned interior to top cap securing arms 32. As horizontal top cap 122 is moved into contact with top frame member 14, flanges 152 engage flange members 36 and deflect inwardly to permit continued movement of horizontal top cap towards top frame member 14. The engagement between flanges 152 and flange members 36 permits horizontal top cap 122 to be releasably engaged with top frame member 14.

Upper web member 140 is preferably provided with curved ends 154. Curved ends define a horizontally extending channel 156. Lower web member 142 has opposed ends 158. Ends 158 extend to a position proximate to the outward extent of vertical faces 22 of top frame member 14. Ends 158 have a lower surface 160 having a first recess to receive top cap securing arms 32 and a second recess 162. Second recess 162 is configured to define opening 164 between second recessed surface 162 and vertical face 22. Accordingly, opening 164 defines a longitudinally extending entrance to channel 38.

Panel member 12 comprises a longitudinally and vertically extending member which extends between vertical frame members 18 and top and bottom frame members 14 and 16. Referring to FIG. 3, panel member 12 has a lightweight inner core 170 and a pair of spaced opposed side panels 172.

Inner core 170 is constructed to have an open cell structure. The open cell structure is a non-structural member. For example, if a small bending force (e.g. several pounds, however depending on the thickness of the walls of the cells, the force may be about 1 pound or less or even about 0.1 pound) were applied in the direction of arrow A of FIG. 1 or the counter-rotational direction as represented by arrow B in FIG. 1, inner core 170 would easily deform. In particular, one side of inner core 170 would undergo compressive movement to define a concave surface. Accordingly, the cells on the side of inner core 170 which undergoes a compressive movement would deform to a closed or a semi-closed position while the cells on the opposed surface of inner core 170 would expand.

Inner core 170 is preferably made from a cellulosic material such as paper or cardboard. Alternately it may be made from a material which, when side panel 172 are affixed thereto, will together with the walls of the cells of inner core 170, maintain the preset shape of the cells 178 of inner core 170. Accordingly, inner core 170 may be made from a thin metal e.g. aluminum. The material is relatively thin and may have a thickness less than about 0.05, more preferably less than about 0.025, more preferably less than about 0.015 and, most preferably less than about 0.01 inches. Accordingly, inner member 170 is of a thin wall construction.

Figure 2:
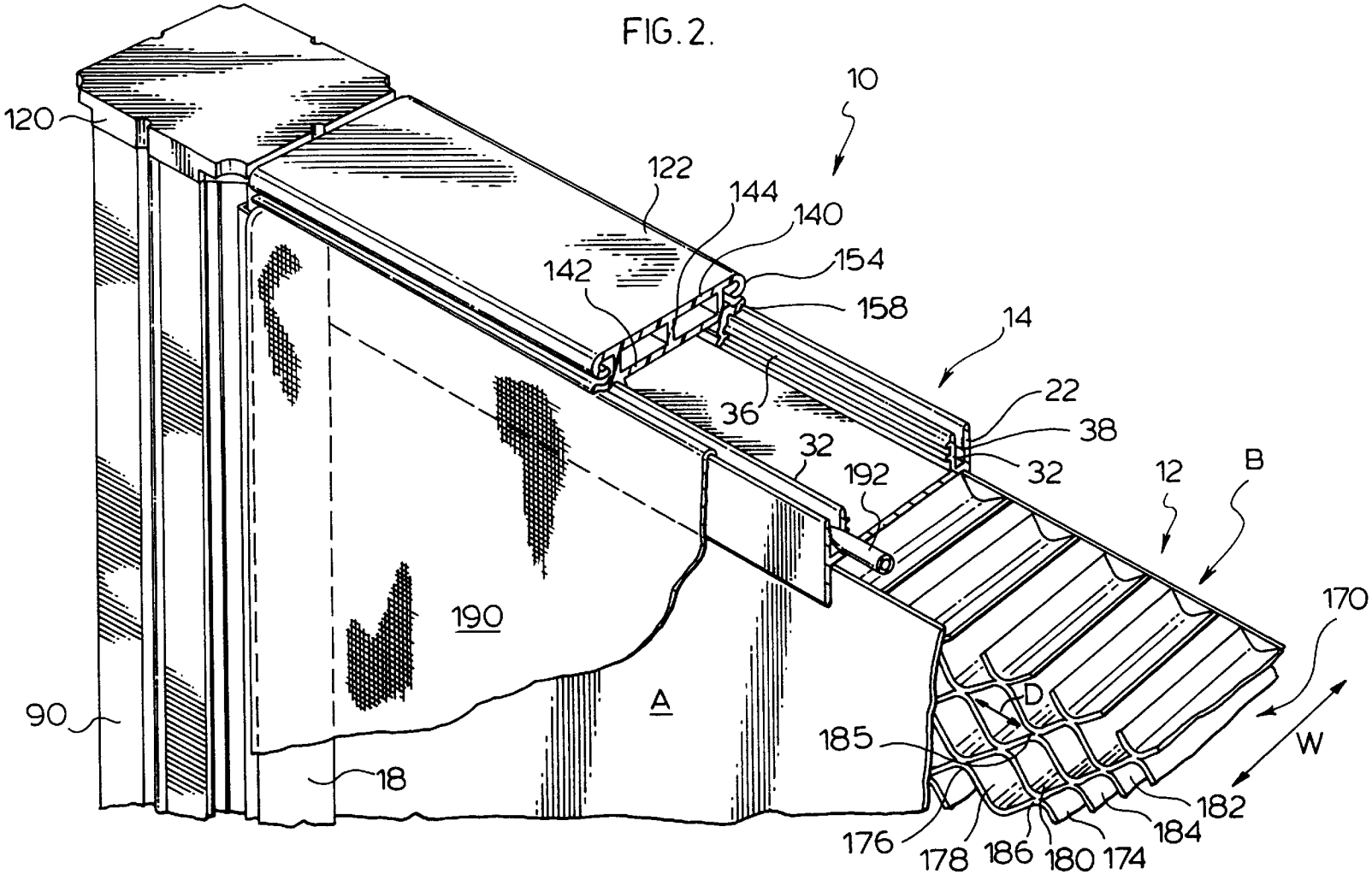
FIG. 2 is a partial cut away section of the panel shown in FIG. 1.

As shown in FIG. 2, inner core 170 may comprise a plurality of longitudinally extending sheets 174 which are affixed to each other at discreet fixed locations 176 so as to define a plurality of cells 178. Sheets 174 may be affixed to each other by any means known in the art and may be affixed by means of an adhesive. According to this construction, each cell 178 is defined by the opening between a lower sheet 174 and the immediate upper sheet 174. Referring to FIG. 2, cell 180 is defined by upper sheet 182 and lower sheet 184. Lower sheet 184 is connected to the immediately lower sheet at connecting point 186. Similarly, upper sheet 182 is connected to the immediately upper sheet at connecting point 188. Preferably, connecting points 182 and 186 are positioned adjacent to the mid-point of cell 186 so as to define the maximum distance between sheets 182 and 184. Accordingly, cell 180 defines a generally longitudinally extending elliptical member.

Cells 170 may have a longitudinally extending diameter defining the cell opening. The cell opening may be less than about 2 inches, more preferably less than about 1.5 inches, more preferably less than about 1.0 inches and, most preferably less than about 0.5 inches. Inner core 170 may have a width W in the transverse direction of 2 inches or less, preferably the width may vary from about 1.5 to about 0.15 inches, more preferably from about 1 to about 0.3 inches and, most preferably from about 0.75 to about 0.50 inches.

Inner core 170 may comprise a single member as shown in FIG. 2. Alternately, a plurality of discrete longitudinally and vertically extending inner cores may be assembled together between a pair of side panels 172. Alternately, a plurality of panel members 12 may be affixed together in a sandwiched fashion so that they are each received in frame members 14, 16 and 18.

Side panels 172 are affixed to the respective side faces of inner core 170 by any means known in the art, such as by an adhesive. Each side panel 172 is constructed from a non-structural material. Accordingly, as with inner core 170, each side panel 172 may compress or bend when a small bending force (e.g. several pounds, however, depending on the thickness of the side panels, the force may be about 1 pound or less or even about 0.1 pound) in the direction of arrows A or B is applied to the side panel prior to it being assembled onto panel member 12. Side panels 172 are selected to have a tensile strength sufficient to prevent compressive movement of the opposed sides of inner core 170. For example, side panel 172 on side A of panel member 12 has a tensile strength sufficient to resist compressive movement of side B of panel member 12 when a compressive force or a bending force is applied to panel member 12. Side panel 172 on side B is selected in a similar manner.

Side panels 172 are preferably constructed from a cellulosic material such as paper or planer cardboard. Alternately, side panels 172 may be constructed from a material which, when affixed to inner core 170, will enable inner core 170 to maintain the preset shape of cells 178. Accordingly, side panels 172 may be made from a thin film or foil (e.g. aluminum). Side walls 172 preferably have a thickness less than about 0.07 inches, more preferably less than about 0.05 inches, more preferably less than about 0.025 inches and, most preferably less than about 0.02 inches.

Despite each of inner core 170 and side panels 172 being of a relatively thin wall construction, when assembled together to form panel 12, they provide a unitary construction which is lightweight and surprisingly strong.

If side panels 172 are made from cellulosic material, they are preferably treated so as to be water resistant or water proof. Accordingly, a water proof coating may be applied to the outer side of side panels 172. For example, the outer side of side panels 172 may be aluminized.

Panel member 12 engages frame member 14, 16 and 18 by any means known in the art. Preferably, panel member 12 is configured to be received within frame member 14, 16 and 18.

Preferably, panel structure 10 is covered with a decorative finish such as fabric 190. (See FIG. 2). Fabric 190 may extend longitudinally across each side panel 172 from one vertically extending channel 52 to a second vertically extending channel 52. Further, fabric 190 may extend vertically across each side panel 172 from one horizontally extending channel 38 to the other horizontally extending channel 38 as shown in FIG. 5. Accordingly, fabric 170 extends across the entire surface of side panel 172.

Fabric 190 may be maintained in position by any means known in the art. Fabric 190 may be maintained in channels 52 and 38 by means of a spline 192. Fabric 190 may be positioned in channels 38 and 52 under tension. Accordingly, once panel member 12 is engaged with frame members 14, 16 and 18, fabric 190 may be inserted into channels 38 and 52 under tension. The tensional forces in fabric 190 maintain the engagement between panel member 12 and frame members 14, 16 and 18. Alternately, or in addition thereto, glue may be applied at the interface between panel members 12 and frame members 14, 16 and 18 so as to maintain panel member 12 in contact with frame members 14, 16 and 18 so as to form a unitary structure. Fabric is preferably applied so as to overlay both side panels 172.

Figure 7:
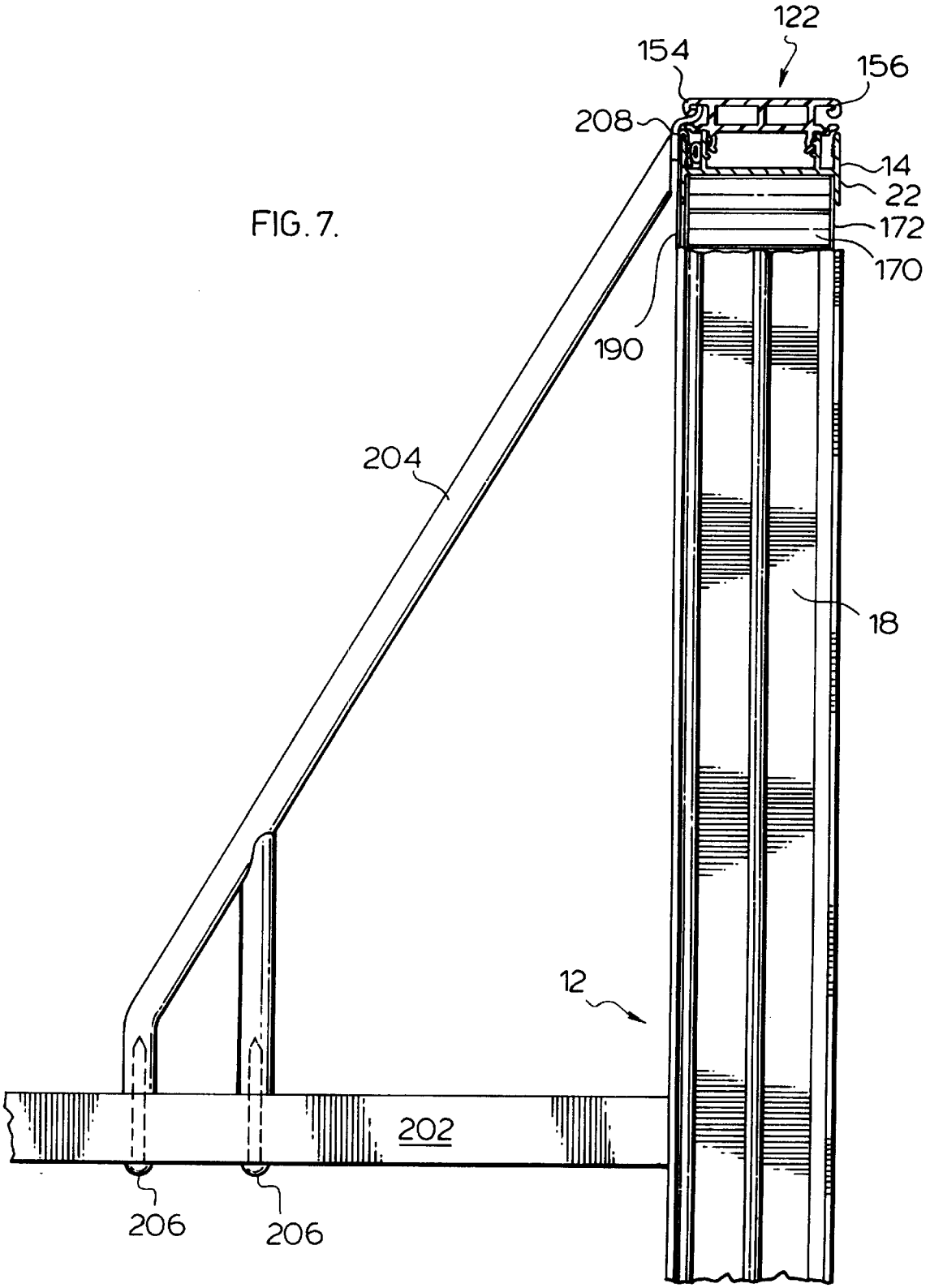
FIG. 7 is a cross section along the line 7—7 of the panel and shelf of FIG. 6.

Referring to FIGS. 6 and 7, a shelf 200 is shown. Shelf 200 comprises a shelf member 202 which is supported by a pair of brackets 204. Bracket 204 may be affixed to shelf 202 by any means known in the art, such as by screws 206 which extend through an opening in shelf member 202 (not shown) and are threadingly engaged in bracket 204. The upper end of bracket 204 has a flange member 208 which is configured to engage end 154 of top cap 122. Engagement between flange 208 and end 154 maintains bracket 204 in position. Bracket 204 may easily be assembled by positioning bracket 204 so as to be generally horizontal and inserting flange 208 into the channel of top cap 122. As bracket 204 is rotated towards the position shown in FIGS. 6 and 7, flange 208 engages end 154. Shelf 202 may be positioned off modular as shown in FIG. 6 so as to abut against panel member 12. Alternately, it will be apparent to those skilled in the art that shelf 200 may be positioned at any desired point along panel member 12 so that it may partially abut against a vertical frame member 18.

Quite surprisingly, it has been found that despite the lightweight construction of panel member 12, not only may a shelf be mounted on panel structure 10, but a substantial weight may be received thereon. In particular, when three panel structures 10 are assembled together to define a generally U-shaped enclosure, a shelf positioned on the centre panel of the enclosure may receive a weight of up to 150 lbs. without deformation of panel member 12. Preferably, if panel structure 10 is to receive a shelf, then inner core 170 preferably has a cell opening of less than about 0.75, more preferably less than about 0.5 and, most preferably less than about 0.3 inches.

It will be apparent to those skilled in the art that various modifications of panel structure 10 may be made and all are within the scope of this invention. For example, the actual configurations of frame members 14 and their inter-engagement with each other or with vertical posts 90 may be varied. Alternate feet, alternate top cap members and alternate configurations of shelf 200 may be utilized. Alternate means of applying fabric 190 to panel structure 10 may also be used. In addition, an alternate configuration of frame members 14, 16 and 18 for receiving therein panel member 12 may be used.

I claim:

1. A panel structure having a perimeter and comprising:

(a) top, bottom and side longitudinally extending frame members defining the perimeter of the panel structure, each of said frame members having a first longitudinally extending face facing outwardly of the panel structure, and opposed longitudinally extending face facing inwardly and opposed longitudinally extending sides defining the width of the panel, said opposed face and opposed longitudinally extending sides defining an internal recess extending transversely across the frame member from one longitudinally extending side to the other longitudinally extending side; and, (b) a panel member extending between said frame members in said recess and abutting against said frame members, said panel extending from one side recess to the other side of said recess so as to be received therein, said panel member comprising:

i. an inner honeycomb core; and, ii. a pair of opposed side panel members having a first side facing transversely outwardly of the panel structure and an opposed side facing transversely inwardly, each of said opposed sides of said opposed side panel members affixed to a respective side of said inner core.

2. The panel structure as claimed in claim 1 wherein said side panels members are constructed from cellulosic material, each of said panel members having a thickness less than about 0.025 inches.

3. The panel structure as claimed in claim 1 wherein said core is constructed from corrugated paper having a thickness less than about 0.025 inches and a cell opening of less than about 1.5 inches.

4. The panel structure as claimed in claim 2 wherein said core is constructed from corrugated paper having a thickness less than about 0.015 inches and a cell opening of less than about 1.0 inches.

5. The panel structure as claimed in claim 1 wherein an adhesive is used to affix said panel member to said frame members.

6. The panel structure as claimed in claim 1 wherein said panel structure further comprises a fabric cover positioned in overlying relationship to each of said first faces of said side panel members, and said frame members have a member to engageably receive said fabric cover and maintaining each of said fabric covers under tensile stress, the tensile stress of said fabric members defining a force drawing opposed frame members towards each other so as to maintain said panel member in position between said opposed frame members.

7. The panel structure as claimed in claim 1 wherein said side panels constructed from a cardboard having a thickness less than about 0.05 inches.

8. The panel structure as claimed in claim 1 wherein said side panels comprise a single layer of material.

9. The panel structure as claimed in claim 1 wherein said side panels comprise non-corrugated layers of material.

* * * * *